US005716002A

United States Patent [19]

Haack et al.

[11] Patent Number: 5,716,002

[45] Date of Patent: Feb. 10, 1998

[54] ULTRASONIC ATOMIZER

[75] Inventors: Olaf Haack, Staffelstein; Klaus Van Der Linden, Coburg; Randolf Mock, München, all of Germany

[73] Assignee: Siemens Aktiengesellschaft, Munich, Germany

[21] Appl. No.: 496,329

[22] Filed: Jun. 29, 1995

[30] Foreign Application Priority Data

Jun. 29, 1994 [DE] Germany ..... 44 22 822.8

[51] Int. Cl.[6] ..... B05B 17/06

[52] U.S. Cl. ..... 239/102.1; 239/102.2; 239/521; 239/523

[58] Field of Search ..... 239/102.1, 102.2, 239/518, 519, 523, 521

[56] References Cited

U.S. PATENT DOCUMENTS

| | | | |
|---|---|---|---|
| 3,214,101 | 10/1965 | Derron | 239/102.2 |
| 3,325,858 | 6/1967 | Ogden et al. | 239/102.2 |
| 3,561,444 | 2/1971 | Boucher | 128/194 |
| 4,085,893 | 4/1978 | Durley, III | 239/102 |
| 4,402,458 | 9/1983 | Lierke et al. | 239/102.2 |
| 4,473,187 | 9/1984 | Lierke et al. | 239/102.2 |
| 4,474,326 | 10/1984 | Takahashi | 239/102 |
| 4,790,479 | 12/1988 | Matsumoto et al. | 239/102.2 |
| 4,888,516 | 12/1989 | Daeges et al. | 239/102.2 |

FOREIGN PATENT DOCUMENTS

| | | |
|---|---|---|
| 0246515 | 11/1987 | European Pat. Off. . |
| 1742584 | 8/1956 | Germany . |
| 3112339 | 3/1989 | Germany . |
| 3-109960 | 5/1991 | Japan . |
| 3-137957 | 6/1991 | Japan . |
| 2 073 616 | 4/1981 | United Kingdom . |

OTHER PUBLICATIONS

Ultraschall "Ultrasound" (Lehfeldt) pp. 30 and 31, Vogel–Verlag 1973.

Siemens, Ultraschall–Aerosole und ihre Verwendung in der Inhalations–Therapie (BISO et al.) pp. 2–15; (Undated).

Ultrasonics Publ. Jul. 1988, vol. 26 (Kruus), pp. 216–217, "Production of zinc dust using ultrasound".

*Primary Examiner*—Andres Kashnikow
*Assistant Examiner*—Lisa Ann Douglas
*Attorney, Agent, or Firm*—Herbert L. Lerner; Laurence A. Greenberg

[57] ABSTRACT

An ultrasonic atomizer includes an electrically excitable piezoceramic and a coupling body being operatively connected to the piezoceramic. The coupling body has a surface coming into contact with a liquid to be atomized and the surface is in the form of a cap-shaped protuberance. The cap-shaped protuberance and the coupling body are formed of a metallic solid material.

9 Claims, 2 Drawing Sheets

ULTRASONIC ATOMIZER

BACKGROUND OF THE INVENTION

1. Field of the Invention

The invention relates to an ultrasonic atomizer for atomizing liquids.

In many technical applications it is necessary to make aerosols from liquids. Particularly for medical applications, it is necessary to atomize a medication, such as a bronchospasmolytic, to make an aerosol that reaches the lungs.

European Patent Application 0 246 515 A1, corresponding to U.S. Pat. No. 4,912,357, discloses an ultrasonic megahertz oscillator, particularly for liquid atomization, in which an amplitude transformer first tapers, beginning at the piezoceramic disk, and then terminates in a widening atomizer plate. The atomizer plate has a concave surface ("concave mirror") for receiving the liquid to be atomized. In the operation of that kind of ultrasonic atomizer, it has been found that high energy losses occur from the reflection of the ultrasonic waves at the boundary layer between the liquid and the air, if the liquid level in the atomizer plate is not suitable.

SUMMARY OF THE INVENTION

It is accordingly an object of the invention to provide an ultrasonic atomizer, which overcomes the hereinaforementioned disadvantages of the heretofore-known devices of this general type, in which the aforementioned energy losses from the reflection of the ultrasonic waves at the boundary layer between the liquid and the air are kept relatively small, and which atomizes relatively small volumes of liquid, such as approximately 50 μl, in such a way as to provide a high proportion of lung-accessible droplets with a diameter of less than 10 μm.

With the foregoing and other objects in view there is provided, in accordance with the invention, an ultrasonic atomizer, comprising an electrically excitable piezoceramic; and a coupling body being operatively connected to the piezoceramic, the coupling body having a surface coming into contact with a liquid to be atomized, the surface being in the form of a cap-shaped protuberance; and the cap-shaped protuberance and the coupling body being formed of a metallic solid material.

The cap-shaped protuberance is intended quite generally to mean a protuberance with a substantially convex surface. The phrase "substantially convex" should also be understood to mean that the surface of the protuberance may be flattened into a plateau. The protuberance need not necessarily be rotationally symmetrical.

In this way, it is possible to couple the ultrasound from the piezoceramic into the coupling body and to focus it in the upper region of the protuberance. When the surface is moistened with the liquid to be atomized, an adequately high proportion of the ultrasonic energy is coupled into the liquid, since because of the substantially convex surface, an especially advantageous liquid level (moistening) is established during the atomization process, so that complete atomization of a relatively small liquid volume with a high proportion of lung-accessible droplets is attained. Moreover, the surface of the coupling body that comes into contact with the liquid to be atomized can be cleaned without difficulty, since there are no indentations or undercuts on the cap-shaped protuberance, or in other words on the substantially convex surface thereof.

In accordance with another feature of the invention, the coupling body is constructed, at the base of the cap-shaped protuberance, as a disk extending beyond the edge of the protuberance, which disk, on the side remote from the protuberance, has a ring for receiving the piezoceramic. In this way, the piezoceramic, which is typically constructed as a disk, can be fixed in a simple way. The disk protruding beyond the edge of the protuberance represents an acoustical bottleneck for the excitation energy.

As a result, first, the energy loss upon the transfer of the ultrasound to a surrounding housing is negligible, and second, the excitation energy is thus coupled into the cap-shaped protuberance to an especially high proportion and is thus utilized for atomizing liquid. Since the ring for form-locking reception of the piezobody is provided on the side remote from the protuberance, an undesirable accumulation of liquid at the base of the cap-shaped protuberance is averted. Moreover, this ring can serve as a fastening in the process of producing the coupling body, if the coupling body is made of metal on a lathe, for instance. A form-locking connection is one which connects two elements together due to the shape of the elements themselves, as opposed to a force-locking connection, which locks the elements together by force external to the elements.

In accordance with a further feature of the invention, the coupling body is formed of metal, preferably titanium or a titanium alloy.

In accordance with an added feature of the invention, in order to provide a uniform distribution of the liquid to be atomized over the protuberance, the cap-shaped protuberance is essentially rotationally symmetrical.

In accordance with an additional feature of the invention, in section, the cap-shaped protuberance is constructed to be parabolic, elliptical or exponential.

In accordance with yet another feature of the invention, the cap-shaped protuberance has a height of approximately 4 mm and a diameter of approximately 10 mm.

In accordance with yet a further feature of the invention, the cap-shaped protuberance has a highest point, and including a supplier for the liquid terminating approximately at the highest point.

Other features which are considered as characteristic for the invention are set forth in the appended claims.

Although the invention is illustrated and described herein as embodied in an ultrasonic atomizer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with accompanying drawing.

DESCRIPTION OF THE PREFERRED EMBODIMENTS

Figure 1:
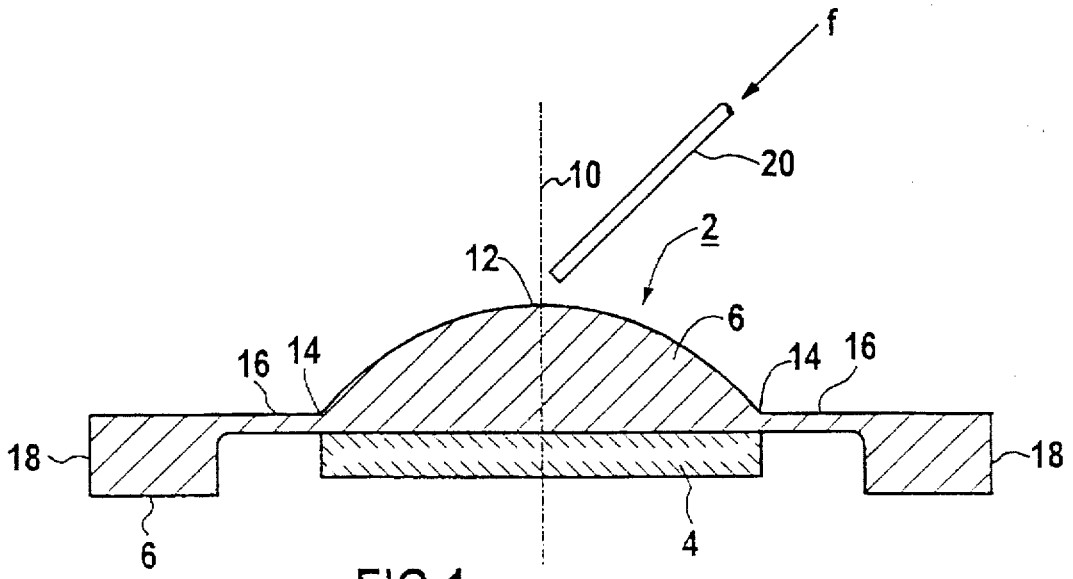
FIG. 1 of the drawings is diagrammatic, longitudinal-sectional view of an ultrasonic atomizer, in conjunction with which an exemplary embodiment of the invention will be described in further detail.

Referring now to FIG. 1 of the drawing in detail, there is seen an ultrasonic atomizer 2 which includes a piezoceramic disk 4 and a coupling body 6. The piezoceramic disk 4 is provided with non-illustrated electrodes, which are connected to a likewise non-illustrated electrical oscillating circuit that excites the piezoceramic. In the exemplary embodiment, the piezoceramic disk 4 is operated by thickness resonance. In other words, sound waves are projected substantially parallel to an axis 10 of rotational symmetry.

The coupling body 6 is formed of a single piece of metal and is made from titanium or a titanium alloy. The coupling body 6 has three different segments:

A first segment is a cap-shaped, and in this case rotationally symmetrical, parabolic protuberance 12, which in the exemplary embodiment has a height of approximately 4 mm and a diameter of approximately 10 mm.

A second segment begins at a base 14 of the parabolic protuberance 12 and extends in the form of a disk 16 markedly beyond an edge of the protuberance 12.

A third segment is represented by a ring 18, which is disposed on a side of the disk 16 that is remote or faces away from the protuberance 12. The piezoceramic disk 4 is concentrically, glued into this ring 18.

During operation of the ultrasonic atomizer 2, a quantity (in medical applications, usually a relatively slight quantity) of liquid f is dripped through a supplier 20 onto the highest point of the protuberance 12. Depending on the viscosity of the liquid f and the adhesion of the liquid f to the metal surface of the coupling body 6 in the region of the protuberance 12, the liquid f spreads over the surface of the protuberance 12 with a relatively uniform, approximately constant-thickness liquid level. In other words, the surface is moistened with the liquid f to be atomized. When the excitation of the piezoceramic disk 4 is turned on, the liquid f that is distributed uniformly over the surface of the protuberance 12 is atomized. The result is a large proportion of droplets having a diameter of less than 10 μm, when excitation is carried out in the megahertz range. Since there is only a slight liquid level on the surface of the protuberance 12, virtually no energy losses occur from reflection of the ultrasound waves at a boundary surface between the liquid and the air. This leads to a rapid development of a lung-accessible aerosol. Byway of example, this aerosol can be inhaled by asthmatics in the form of an aerosolized bronchospasmolytic. Since the coupling body 6 is preferably formed of titanium or a titanium alloy, the coupling body 6 and the liquid f to be atomized have only a slight difference in sonic resistance, which has a favorable effect on a reflection factor of the sound pressure.

In terms of the shape of the protuberance 12, it should be noted that it need not necessarily be rotationally symmetrical. The protuberance can also be flattened at the highest point, without there being a "concave mirror" that acts as a collecting basin for the liquid to be atomized.

Figure 2:
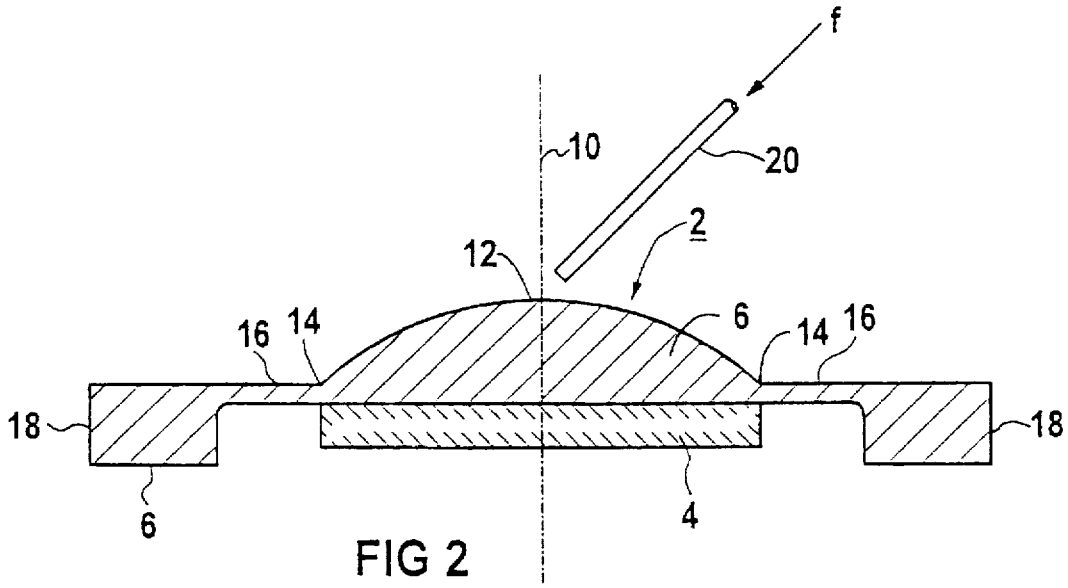
FIGS. 2, 3, and 4 show the cap-shaped protuberance as being constructed ellipically, parabolically or exponentially, respectively.
Figure 3:
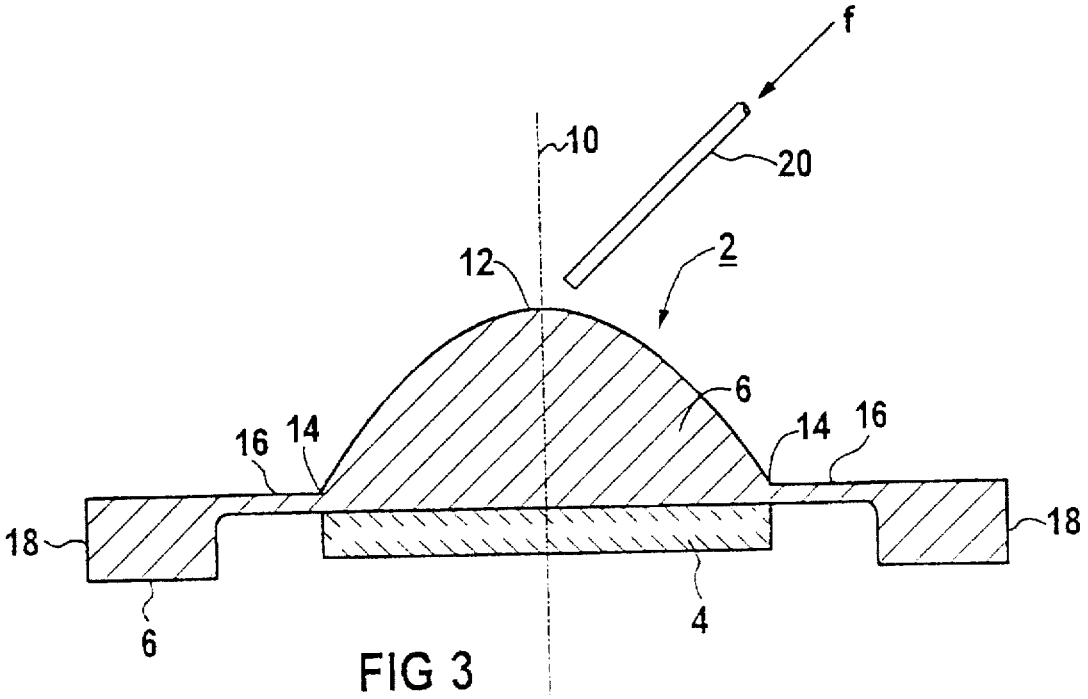
Figure 4:
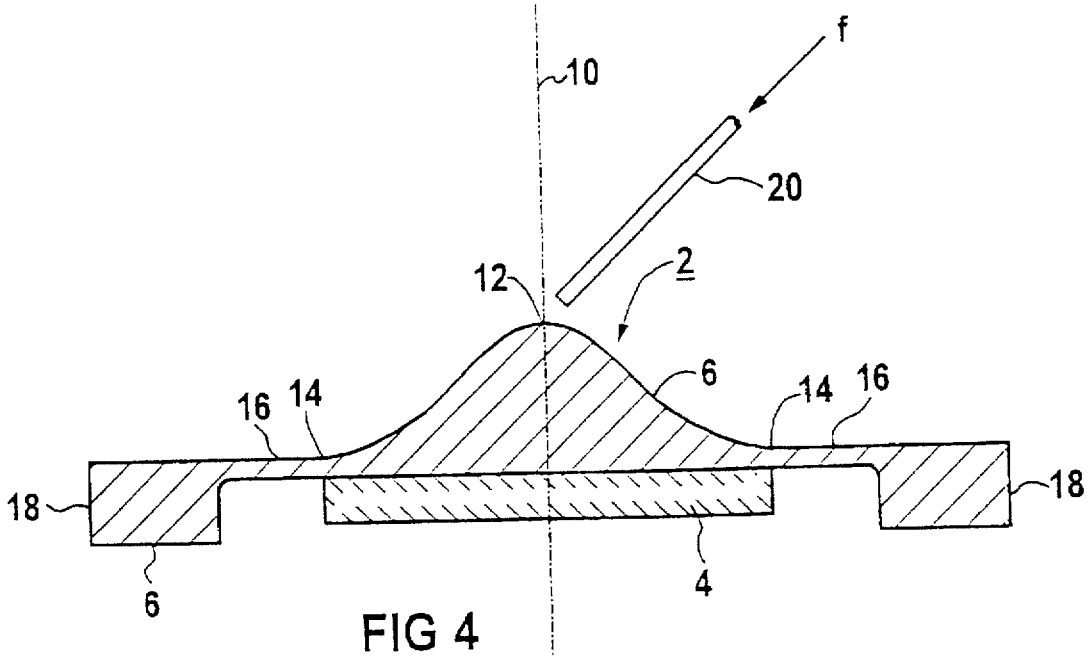

In accordance with an additional feature of the atomizer 2, in section, and referring to FIGS. 2, 3 and 4, the cap-shaped protuberance may be constructed elliptical, parabolic or exponential, respectively.

We claim:

1. An ultrasonic atomizer, comprising:

an electrically excitable piezoceramic; and a coupling body being operatively connected to said piezoceramic, said coupling body having a surface coming into contact with a liquid to be atomized, said surface being in the form of a cap-shaped protuberance, having a base and an edge, said coupling body being in the form of a disk at said base of said protuberance extending beyond said edge of said protuberance; and said cap-shaped protuberance and said coupling body being formed of a metallic solid material and an entire space defined between said base and said surface, and extending to said edge, being filled with said metallic solid material.

2. The ultrasonic atomizer according to claim 1, wherein said cap-shaped protuberance has a highest point, and including a supplier for the liquid terminating approximately at said highest point.

3. The ultrasonic atomizer according to claim 1, wherein said coupling body is formed of a material selected from the group consisting of titanium and a titanium alloy.

4. The ultrasonic atomizer according to claim 1, wherein said cap-shaped protuberance is substantially rotationally symmetrical.

5. The ultrasonic atomizer according to claim 1, wherein said cap-shaped protuberance is elliptical in section.

6. The ultrasonic atomizer according to claim 1, wherein said cap-shaped protuberance is parabolic in section.

7. The ultrasonic atomizer according to claim 1, wherein said cap-shaped protuberance is constructed in accordance with an exponential function in section.

8. The ultrasonic atomizer according to claim 1, wherein said cap-shaped protuberance has a height of approximately 4 mm and a diameter of approximately 10 mm.

9. An ultrasonic atomizer comprising:

an electrically excitable piezoceramic; and a coupling body being operatively connected to said piezoceramic, said coupling body having a surface coming into contact with a liquid to be atomized, said surface being in the form of a cap-shaped protuberance, having a base and an edge, said coupling body being in the form of a disk at said base of said protuberance extending beyond said edge of said protuberance; and said cap-shaped protuberance and said coupling body being formed of a metallic solid material, said coupling body having a side facing away from said protuberance and a ring at said side for receiving said piezoceramic.

* * * * *